US005333859A

United States Patent [19]

Teramoto et al.

[11] Patent Number: 5,333,859

[45] Date of Patent: Aug. 2, 1994

[54] CONSTANT SWING GOLF CLUB SET BY VARIED CLUB LENGTH

[75] Inventors: Mitsutake Teramoto, Kamakura; Takaharu Okumoto, Chigasaki; Teruo Goto, Tokyo; Shinkichi Saito, Tokyo; Hideyo Asabuki, Tokyo, all of Japan

[73] Assignee: The Yokohama Rubber Co., Ltd., Tokyo, Japan

[21] Appl. No.: 881,083

[22] Filed: May 11, 1992

Related U.S. Application Data

[60] Division of Ser. No. 784,678, Oct. 29, 1991, Pat. No. 5,121,918, which is a continuation of Ser. No. 531,091, May 31, 1990.

[30] Foreign Application Priority Data

Jun. 13, 1989 [JP] Japan ..... 1-68111

[51] Int. Cl.[5] ..... A63B 53/00

[52] U.S. Cl. ..... 273/77 A

[58] Field of Search ..... 273/77 R, 77 A, 80 R, 273/80 A

[56] References Cited

U.S. PATENT DOCUMENTS

| | | | |
|---|---|---|---|
| 3,984,103 | 10/1976 | Nix | 273/77 A |
| 4,461,479 | 7/1984 | Mitchell | 273/81 A |
| 4,679,791 | 7/1987 | Hull | 273/77 A |
| 4,784,390 | 11/1988 | Horgen | 273/77 A |
| 4,971,321 | 11/1990 | Davis | 273/77 A |

*Primary Examiner*—Vincent Millin
*Assistant Examiner*—William M. Pierce
*Attorney, Agent, or Firm*—Finnegan, Henderson, Farabow, Garrett & Dunner

[57] ABSTRACT

An iron golf club set characterized in that the difference of the club lengths between at least two adjacent golf clubs in terms of the club number in a middle iron golf club group is set to be greater than the pitch difference of the club length between the club numbers in a long iron golf club group and the pitch difference of the club lengths between the club numbers in a short iron golf club group.

5 Claims, 3 Drawing Sheets

CONSTANT SWING GOLF CLUB SET BY VARIED CLUB LENGTH

This is a division of application Ser. No. 07/784,678, filed Oct. 29, 1991, now U.S. Pat. No. 5,121,918 which is a continuation of application Ser. No. 07/531,091, filed May 31, 1990.

BACKGROUND OF THE INVENTION

This invention relates to an iron golf club set consisting, as a unit, of a long iron golf club group, a middle iron golf club group and a short iron golf club group.

Generally, an iron golf club set consists of at least ten iron golf clubs, i.e. nine iron golf clubs having the club numbers of #1 to #9 and one iron golf club of a pitching wedge PW, as a unit. These golf clubs are classified in accordance with their club length. The golf clubs of the club numbers #1 to #3 are referred to as "long iron golf clubs", those of #4 to #6 are referred to as "middle iron golf clubs" and those of #7 to #9 and the pitching wedge iron golf club PW are referred to as "short iron golf clubs". The long iron golf clubs are used in order to obtain a long flying distance of a ball or "yardage", the middle iron golf clubs are used to obtain a middle flying distance and the short iron golf clubs, to obtain a short flying distance.

Conventionally, the iron golf clubs constituting the iron golf club set are arranged in such a way that when the three groups of golf clubs, that is, the long iron golf clubs $I_L$, the middle iron golf clubs $I_M$ and the short iron golf clubs $I_S$, are arranged in accordance with the club numbers with predetermined gaps between them, their club length l becomes progressively shorter when the club number # becomes greater. These iron golf clubs are characterized in that directionality of the hit ball is more accurate than in the case of wood golf clubs, and their club length is set to be shorter than that of the wood golf clubs. Therefore, those golf players such as amateurs who cannot gain a large distance or yardage use a wood golf club without using the long iron golf club when they wish to gain a large yardage on a fairway and cannot therefore utilize excellent directionality of the hit ball that the iron golf club has.

In order to solve the problem described above, the inventors of the present invention previously proposed in Japanese Utility Model Application Kokai Publication No. 62-172467, wherein the change ratio of the club length l from the long iron golf club $I_L$ to the intermediate member of the middle iron golf clubs $I_M$ is made greater than that in the prior art example as shown in FIG. 5 and also in Japanese Utility Model Application Kokai Publication No. 62-174556, wherein a large step is given to the change of the club length l at the intermediate part of the middle iron golf club group $I_M$ and the club length l on the side of the long iron golf club group $I_L$ is made drastically greater than that in the prior art example, as shown in FIG. 5. According to the former, however, the pitch difference of the club length between the golf clubs constituting the long iron golf club group becomes too great and according to the latter, on the other hand, the club length changes remarkably between two specific golf clubs at the intermediate part of the middle iron golf club group. Accordingly, there occurs the problem that the relation between the feel at the time of swing and the flying distance of the hit ball is likely to deviate between both golf clubs having such a great difference of the club length.

SUMMARY OF THE INVENTION

It is an object of the present invention to provide an iron golf club set which can increase the flying distance of a hit ball by the long iron golf clubs.

It is another object of the present invention to provide an iron golf club set which increases the flying distance of the hit ball by the long iron golf clubs while changing smoothly the relation between the flying distance of the hit ball and the feel at the time of swing between the golf clubs having the club numbers adjacent to each other.

In an iron golf club set consisting of a long iron golf club group, a middle iron golf club group and a short iron golf club group, the present invention for accomplishing the objects described above is characterized in that the difference of the club length of at least two golf clubs in the middle iron golf club group is set to be greater than the pitch difference of the club length between the club numbers of the golf clubs of the long iron golf club group and than the pitch difference of the club length between the club numbers of the golf clubs of the short iron golf club group.

The iron golf club set in accordance with present invention comprises a long iron golf club group consisting of a plurality of golf clubs aligned in the same club length irrespective of their club numbers, a middle iron golf club group consisting of a plurality of golf clubs whose club length decreases progressively with an increasing club number, and a short iron golf club group consisting of a plurality of golf clubs aligned in the same club length irrespective of their club numbers.

According to the structure described above, the club length of the long iron golf club group is increased as a whole in comparison with the iron golf club set shown in FIG. 5 but the difference of the club length between the golf clubs constituting the long iron golf club set is not increased extremely. It is also possible according to this structure to eliminate the necessity for providing a remarkable difference of the club length to only limited golf clubs of the middle iron golf club set. Accordingly, the relation between the flying distance of the ball and the feel at the time of swing can be changed smoothly between those golf clubs which have adjacent club numbers, while increasing the flying distance of the hit ball by the long iron golf clubs.

DESCRIPTION OF THE PREFERRED EMBODIMENTS

Figure 1:
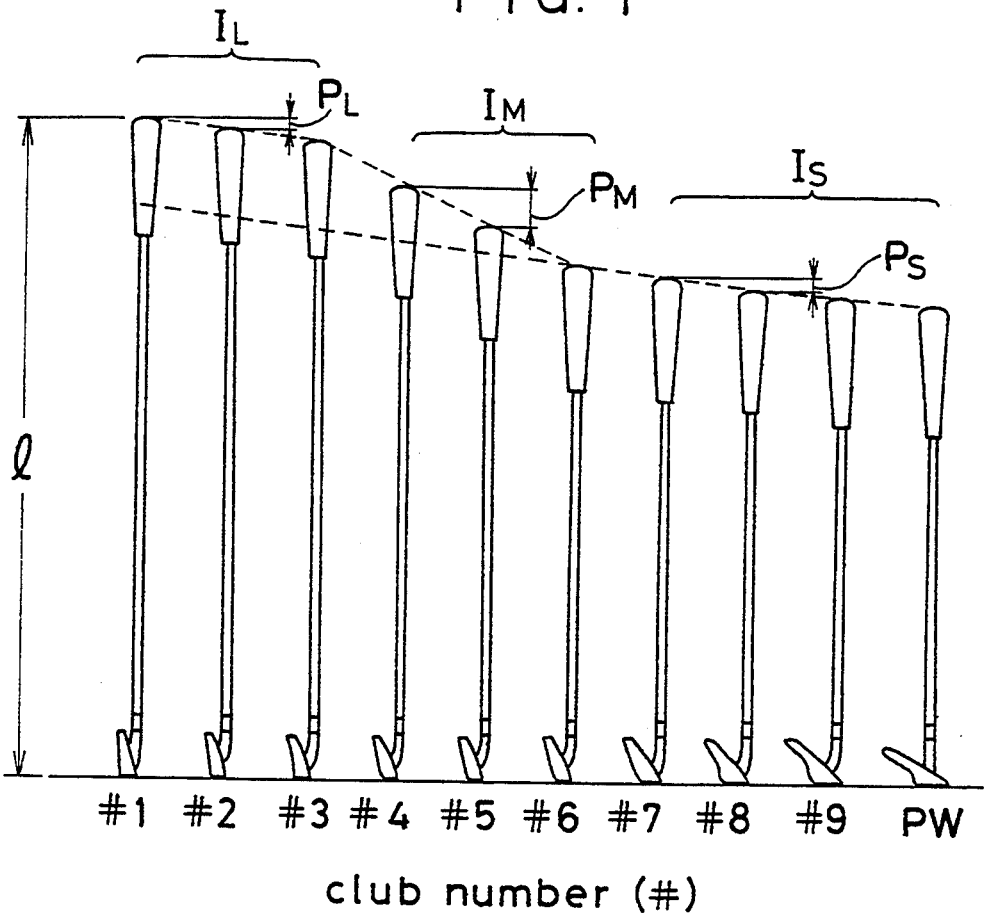
FIG. 1 is a view showing the disposition of iron golf clubs that constitute an iron golf club set of the present invention and are aligned in with predetermined gaps between them in accordance with the club number.

In FIG. 1, there is shown disposed an iron golf club set of the present invention which comprises a group of three long iron golf clubs $I_L$ of the club numbers #1 ~#3, a group of three middle iron golf clubs $I_M$ of the club numbers #4 ~#6 and a group of four short iron golf clubs $I_S$ of the club numbers #7 ~#9 and a pitching wedge PW. These golf clubs are aligned with predetermined gaps between them. In these long iron golf club group, middle iron golf club group and short iron golf club group, the club length l decreases progressively by a predetermined pitch difference $P_L$, $P_M$, $P_S$ with an increasing club number.

In this embodiment the pitch difference of the club length between the #3 golf club having the greatest club number in the long iron golf club group and the #4 golf club having the smallest club number in the middle iron golf club group is set to be equal to the pitch difference $P_M$ of the middle iron golf club group. The pitch difference of the club length between the #6 golf club having the greatest club number in the middle iron golf club group and the #7 golf club having the smallest club number in the short iron golf club group is set to be equal to the pitch difference $P_S$ of the short iron golf club group.

As described above, the pitch difference $P_L$ of the long iron golf club group and the pitch difference $P_S$ of the short iron golf club group in the present invention are set to be equal to each other but the pitch difference $P_M$ of the middle iron golf club group is set to a value greater than the pitch differences $P_L$ and $P_S$. In other words, when the top of each golf club is connected by a dash line, the gradient of the dash line connecting the tops of the golf clubs of the long iron golf club group is equal to the gradient of the dash line connecting the tops of the golf clubs of the short iron golf club group but the dash line connecting the tops of the golf clubs of the middle iron golf club group is greater than these gradients.

Figure 5:
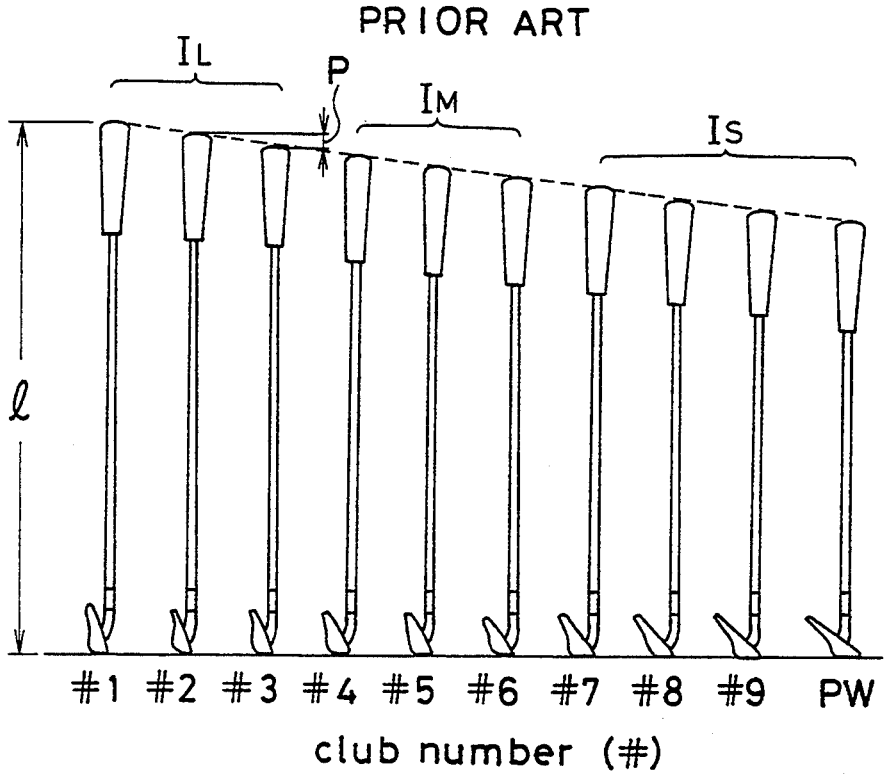
FIG. 5 PRIOR ART
FIG. 5 is a view showing the disposition of iron golf clubs that constitute an iron golf club set of a prior art example and are aligned with predetermined gaps between them in accordance with the club number.
Figure 6:
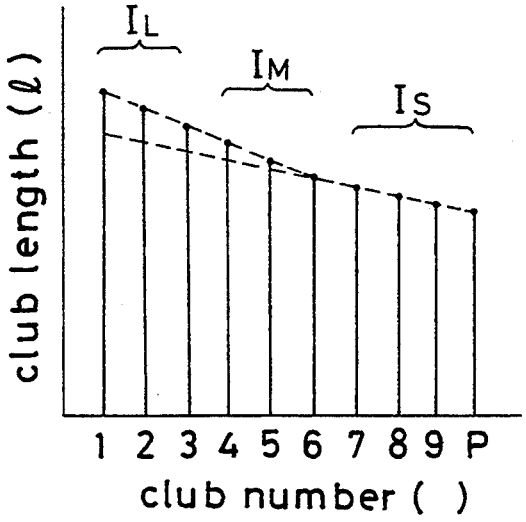
FIG. 6 PRIOR ART
FIGS. 6 and 7 are diagrams each showing the disposition Of iron golf clubs that constitute an iron golf club set as another prior art example and are alinged with predetermined gaps between them in accordance with the club number.
Figure 7:
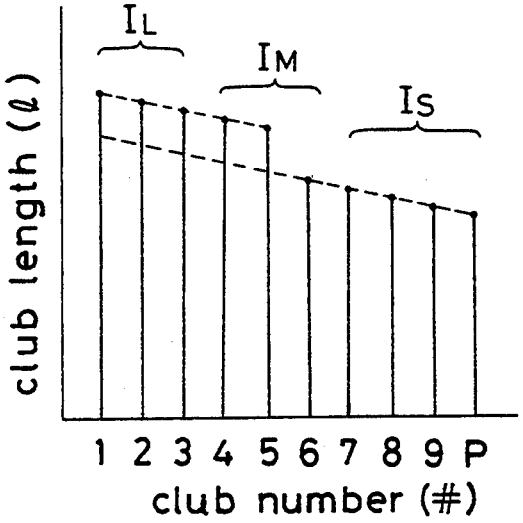
FIG. 7 PRIOR ART

The pitch differences $P_L$, $P_S$ of the long and short iron golf club groups may be substantially equal to the pitch difference P of the conventional iron golf club set shown in FIG. 5 and ½ inch, for example, can be employed. In contrast, a greater value such as ⅔ in., ¾ in., 5/6 in., etc., is employed for the pitch difference $P_M$ of the middle iron golf club group.

Since the middle iron golf club group has the structure as described above, the club length l of the long iron golf club group can be made greater as a whole than in the prior art while the club length l of the short iron golf club group is kept at the same length of the prior art. Since the club length of the long iron golf club group is thus increased, even an amateur can hit a ball in a greater flying distance.

As to the #3 golf club having the greatest club number in the long iron golf club group and to the #4 golf club having the smallest club number in the middle iron golf club group, the change of the club length l corresponds to the change of the gradient from the gradient of the pitch difference $P_L$ to that of the pitch difference $P_M$. Therefore, the change is smooth and the relation of the flying distance of the hit ball and the feel at the time of swing can be made a smooth change between the golf clubs of both groups.

In the present invention, the relation that the pitch difference $P_M$ is greater than the pitch differences $P_L$ and $P_S$ need not always be satisfied between all the golf clubs constituting the middle iron golf clubs but may be satisfied between at least two golf clubs. In other words, in the embodiment shown in FIG. 1, the pitch difference $P_M$ between the #4 and #5 golf clubs and the pitch difference $P_M$ between the and #6 golf clubs are greater than the pitch differences $P_L$, $P_S$, but only the pitch difference $P_M$ between the two golf clubs #4 and #5 may be greater than the pitch differences $P_L$, $P_S$ as in the embodiment shown in FIG. 2. In this FIG. 2, the pitch difference between the #5 and 6 golf clubs is equal to the pitch difference $P_S$ of the short iron golf club group.

Figure 2:
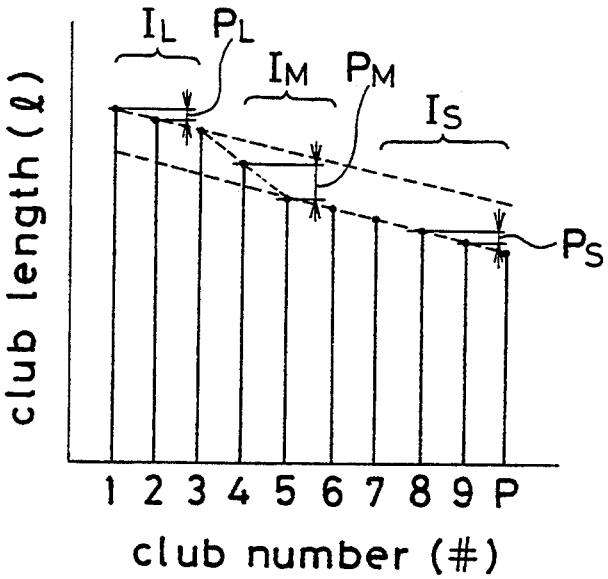
FIGS. 2 to 4 are views each showing the iron golf clubs that constitute the iron golf club set in another embodiment of the present invention and are aligned with predetermined gaps between them in accordance with the club number.
Figure 3:
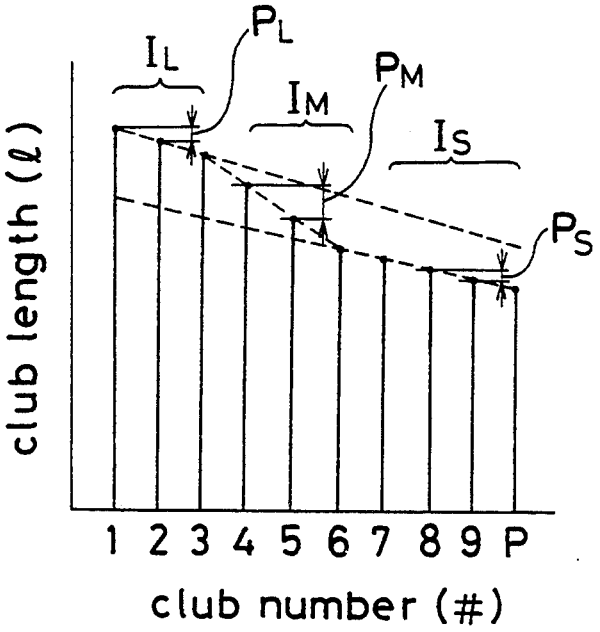

In the present invention, the pitch difference $P_L$ of the long iron golf club group and the pitch difference $P_S$ of the short iron golf club group need not always be equal to each other as shown in FIGS. 1 and 2. For example, the pitch difference $P_L$ of the long iron golf club group may be greater than the pitch difference $P_S$ of the short iron golf club group as in the embodiment shown in FIG. 3. However, this pitch difference $P_L$ must not be greater than the pitch difference PM of the middle iron golf club group.

Figure 4:
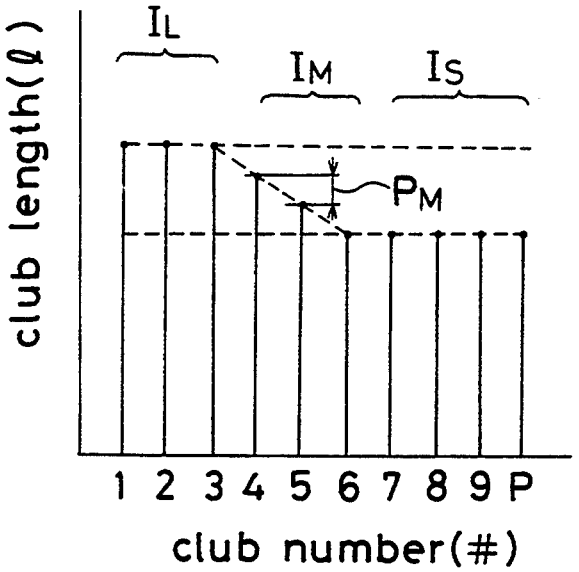

In an alternative embodiment of the iron golf club set in accordance with the present invention, the club length l of all the golf clubs constituting the long iron golf club group maybe same as shown in FIG. 4 and the club length l of all the golf clubs constituting the short iron golf club set the same, though it is smaller than the club length l of the long iron golf club group. Only the club length of the golf clubs constituting the middle iron golf club group changes with a predetermined pitch difference between them.

The following table illustrates a definite example of the iron golf club set in accordance with the present invention described above.

| Club number | Club length (inch) | | | | | | | |
|---|---|---|---|---|---|---|---|---|
| | Embodiment 1 | | Embodiment 2 | | Embodiment 3 | | Prior Art Example | |
| #1 | 40 | | 40 | | 41 | | 39½ | |
| #2 | 39½ | (½) | 39½ | (½) | 40¼ | (¾) | 39 | (½) |
| #3 | 39 | (½) | 39 | (½) | 39½ | (¾) | 38½ | (½) |
| #4 | 38⅓ | (⅔) | 38¼ | (¾) | 38⅔ | (5/6) | 38 | (½) |
| #5 | 38⅔ | (⅔) | 37½ | (¾) | 37 5/6 | (5/6) | 37½ | (½) |
| #6 | 37 | (⅔) | 37 | (½) | 37 | (5/6) | 37 | (½) |
| #7 | 36½ | (½) | 36½ | (½) | 36½ | (½) | 36½ | (½) |
| #8 | 36 | (½) | 36 | (½) | 36 | (½) | 36 | (½) |
| #9 | 35½ | (½) | 35½ | (½) | 35½ | (½) | 35½ | (½) |
| PW | 35 | (½) | 35 | (½) | 35 | (½) | 35 | (½) |

In the table above, the numeric value in the parenthesis represents the pitch difference of the club length between one golf club and another golf club having a preceding club number. Embodiments Nos. 1, 2 and 3 correspond to the embodiments shown in FIGS. 1, 2 and 3, respectively. The prior art example corresponds to the example shown in FIG. 5. In the iron golf club sets shown in the Embodiments Nos. 1~3, each short iron golf club group has the same club length and the same pitch difference as those of the prior art example but each long iron golf club group has a greater club length because the middle iron golf club group having a greater pitch difference exists between the short- and long-iron golf club groups. Accordingly, even an amateur can hit a ball with a greater flying distance by use of such long iron golf clubs. Since the club length of the middle iron golf club group continues the club length of the long iron golf club group with the predetermined pitch difference, the relationship of the flying distance of the ball and the feel between both golf club groups can be changed smoothly.

As to the classification of iron golf clubs, it is customary to classify the #1 ~#3 golf clubs into the long iron golf clubs, #4 ~#6 golf clubs into the middle iron golf clubs and #7 ~#9 golf clubs and the pitching wedge PW into the short iron golf clubs as in the embodiments described above. However, there is the case in the golf industry where the #1 ~#4 golf clubs are classified into the long iron golf clubs, #5 ~#7 golf clubs into the middle iron golf clubs and #8, #9 golf clubs and the pitching wedge PW into the short golf clubs. The present invention can also be applied to the latter case.

What is claimed is:

1. An iron golf club set of consecutively numbered clubs comprising a long iron golf club group, a middle iron golf club group and a short iron golf club group, each group consisting of two or more iron golf clubs, all of the iron golf clubs having a club number that increases from a first club in the long iron group to a last club in the short iron group, said golf clubs in said long iron group having a constant club length, said golf clubs in said middle iron group having a club length that decreases with increasing club number from the longest club in said middle iron group to the shortest club in said middle iron group and said golf clubs in said short iron group having a constant club length, the length of the short iron golf clubs being shorter than the length of the long iron golf clubs and the length of the middle iron golf clubs being no longer than the length of the long iron golf clubs and no shorter than the length of the short iron golf clubs wherein the length of the iron golf club having the smallest club number in said middle iron group is shorter than the iron golf club having the largest number in said long iron group.

2. The iron golf club of claim 1, wherein the length of the iron golf club having the largest club number in said middle iron group is equal to the length of the iron golf clubs in said short iron group.

3. The iron golf club set of claim 1, wherein the length of the clubs in said middle iron group decrease at a constant pitch difference $P_M$ with increasing club number.

4. The iron golf club set of claim 1, wherein the length of the clubs in said middle iron group decrease at a constant pitch difference $P_M$ with increasing club number, the difference between the length of the iron golf club having the smallest club number in said middle iron group and the length of the iron golf club having the highest club number in said long iron group being equal to the pitch difference $P_M$.

5. The iron golf club set of claim 1, wherein the long iron group includes three iron golf clubs numbered 1 to 3, the middle iron group three iron golf clubs numbered 4–6, and the short iron group, three iron golf clubs numbered 7–9.

* * * * *